United States Patent [19]

Bale

[11] Patent Number: 5,020,680

[45] Date of Patent: Jun. 4, 1991

[54] DISPOSABLE NURSER SHELL AND HOOD

[75] Inventor: Bart Bale, Chagrin Falls, Ohio

[73] Assignee: Spalding & Evenflo Companies, Inc., Tampa, Fla.

[21] Appl. No.: 481,007

[22] Filed: Feb. 16, 1990

[51] Int. Cl.[5] ..... A61J 9/00; A61J 9/06; A61J 9/08

[52] U.S. Cl. ..... 215/11.6; 215/11.3

[58] Field of Search ..... 215/11.3, 11.6, 11.1, 215/11.4, 11.5

[56] References Cited

U.S. PATENT DOCUMENTS

| | | | |
|---|---|---|---|
| 1,429,585 | 9/1922 | Hagerty | 215/11.6 |
| 1,649,580 | 11/1927 | Geisler | 215/11.6 |
| 3,310,190 | 3/1967 | Hurst | 215/11.6 |
| 3,549,036 | 12/1970 | Ritsi | 215/11.6 |
| 3,627,161 | 12/1971 | Wergeland | 215/11.6 |
| 3,822,806 | 7/1974 | Grimes | 215/11.3 |
| 4,238,090 | 12/1980 | Fitzpatrick | 215/11.3 |
| 4,533,057 | 8/1985 | Klittich | 215/11.3 |
| 4,623,068 | 11/1986 | Brown et al. | 215/11.1 |

*Primary Examiner*—Sue A. Weaver

*Attorney, Agent, or Firm*—Donald R. Bahr

[57] ABSTRACT

A nursing unit is disclosed including a holder for a disposable liquid-retaining bag, the holder comprising an elongated tubular body open at both ends and having external threading at one end, an internally threaded retainer ring adapted to mate with the external threading on the tubular body, and a protective substantially rigid hood having an opening of a dimension to frictionally fit about said retainer or frictionally fit about the other open end of the tubular body.

1 Claim, 1 Drawing Sheet

DISPOSABLE NURSER SHELL AND HOOD

This invention relates to nursing bottles or holders of the type used to contain collapsible liquid-retaining bags. More particularly, the invention relates to a nurser holder including a hood which covers the nipple when the nurser is not in use and which may be used to cover the open end of the nurser when it is in use.

Nursing holders of the type described herein are generally known and typically include a hollow tubular body adapted at one end to receive a collapsible liquid-retaining bag and a nipple. In many of these nursers the nipple and the collapsible bag are held in place by a retainer ring.

The use of these bottles has two distinct disadvantages. One disadvantage is that the bottom of the holder is open and, thus, the lower part of the collapsible bag is exposed. This means that the child could stick his hand or fingers into the opening and possibly puncture the bag, or he could insert any toy or the like into the holder and also puncture the bag.

Another disadvantage is that the way holders are made in usual mass production, they present a relatively sharp edge at the lower opening of the holder and sometimes, due to particular configuration, may even present some sharp-pointed areas. Babies using this type of nurser could have their delicate skin cut or abraded by this type of nurser.

Accordingly, it is an object of this invention to provide a hood for a nurser which serves the dual purpose of protecting the nipple when the nurser is not in use and of covering the open end of the nurser when it is in use.

Other objects of the invention will become apparent from the following description taken together with the drawings.

SUMMARY OF THE INVENTION

The invention provides a nursing unit including a holder for a disposable liquid-retaining bag. The holder comprises an elongated tubular body open at both ends and having external threading at one end with an internally threaded retainer ring adapted to mate with the external threading on the tubular body so as to retain the disposable bag and the nipple when the nursing unit is in use. A protective, substantially rigid hood is provided. The hood has an opening of a dimension which fits frictionally about the retainer when the unit is not in use, and frictionally fits about the open end of the tubular body when the unit is in use. The second use of the hood covers the opening in the tubular body and also covers the sharper edges about the opening.

DETAILED DESCRIPTION OF THE PREFERRED EMBODIMENTS

Figure 1:
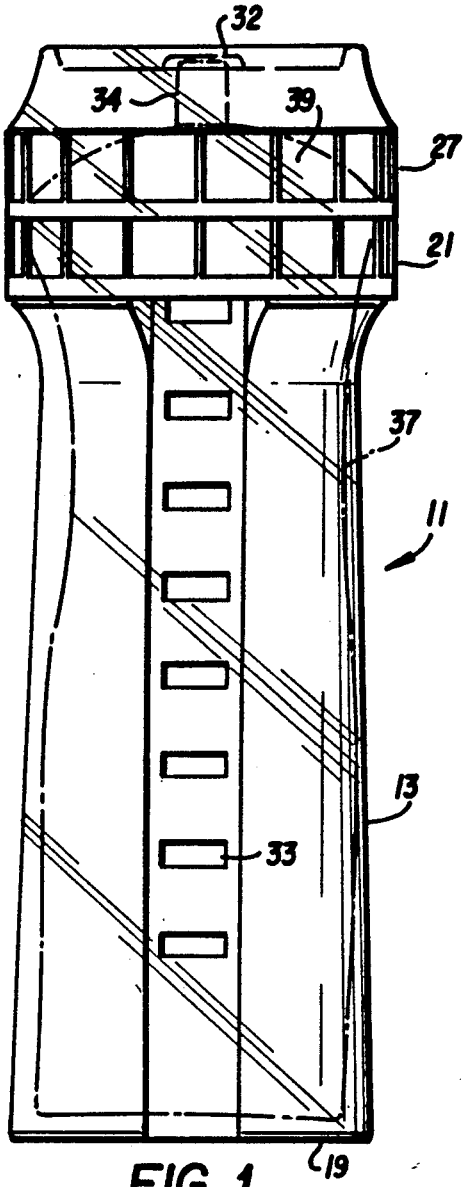
FIG. 1 is a front view of the nursing unit of the present invention with the parts in place when the unit is not in use.
Figure 2:
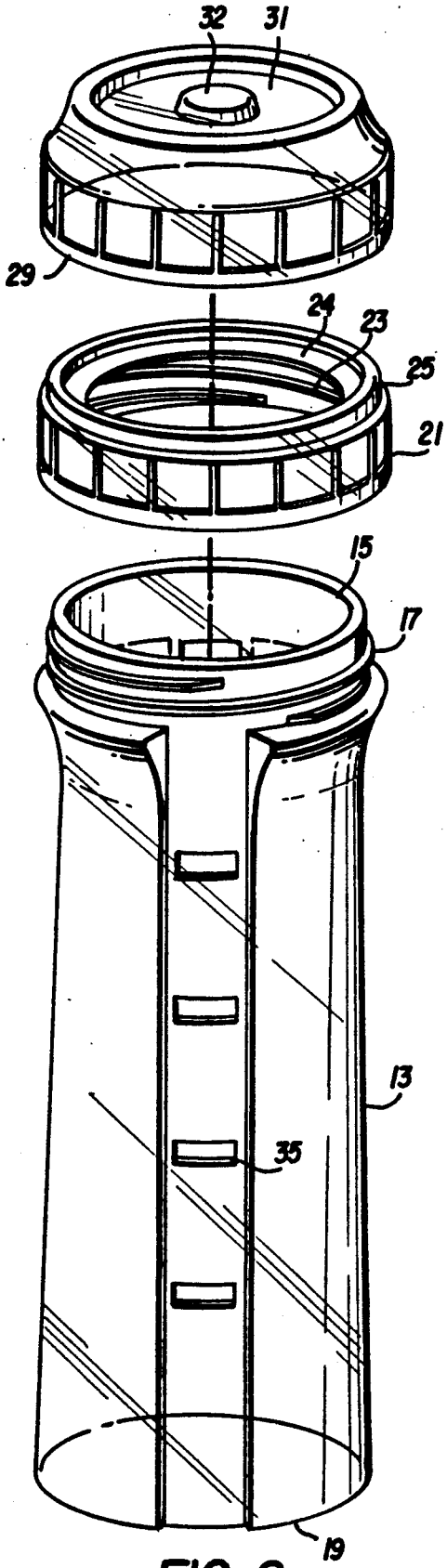
FIG. 2 is an exploded view of the nursing unit components of FIG. 1.

Turning now to FIGS. 1 and 2, there is shown one embodiment of the present invention. Shell 11 is shown assembled in FIG. 1 and in an exploded view in FIG. 2. Shell 11 includes an elongated tubular body 13 open at both ends 15 and 19. Open end 15 has external threading 17 about its circumference.

Retainer ring 21 includes internal threading 23, which is adapted to mate with external threading 17 of elongated tubular body 13. Circumferential flange 24 extends inwardly from the wall of ring 21 above internal threading 23. As is standard practice, retainer ring 21 is used to secure both the nipple and the disposable, collapsible bag used with the unit.

Hood 27 is also supplied with the nurser. This hood has a dual purpose which will be discussed as the description proceeds. The hood includes a cylindrical skirt 30 which is open at one end 29 and closed at the other end 31. Closed end or top panel 31 includes internal indentation 32, the purpose of which will become apparent as the description proceeds. Retainer 21, in the instance shown, includes lip 25 on the upper surface thereof. The outer diameter of lip 25 is configured so that the interior of opening 29 of hood 27 frictionally fits about lip 25 so that the hood is removably secured to the retainer.

Referring to FIG. 1, hood 27 is shown in place over retainer ring 21. As can be seen, section 34 of nipple 39 (shown in dotted lines) extends upwardly within indentation 32 so as to effectively prevent the nipple from leaking. Also illustrated in FIG. 1 is collapsible bag 37 (shown in dotted lines), which is a standard type of disposable bag and is shown in place within the holder. Additionally, measurement markings 33 and 35 are also indicated. It should be noted that the view of FIG. 2 is of the reverse side of the bottle of FIG. 1.

Figure 3:
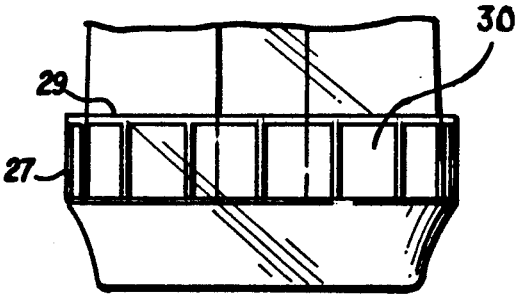
FIG. 3 is a partial view of the hood of the present invention in place about the open end of the nursing unit.

As discussed above, it is desirable to cover opening 19 of elongated tubular body 13 in order to prevent access to the interior of the tube and the collapsible bag, and also to cover the sharp, rough edges of open end 19. In order to accomplish this, the circumference of open end 19 is of a configuration so that it is adapted to frictionally fit within opening or top panel 29 and the skirt 30 of hood 27 as shown in FIG. 3. A substantial portion of the interior surface of the skirt 30 is of constant diameter such that it continuously, frictionally engages the open end 19 of the tubular body as the hood is pressed over the open end 19. This not only protects the bag within tubular body 13 and covers the sharp edges of open end 19, it also provides a place for fitting hood 27 to body 13 while the bottle is in use. This eliminates the possibility of displacing or losing the hood when the bottle is in use.

It is to be understood that the above description and drawings are illustrative, only, since modifications as to shape and dimensions could be altered without departing from the invention, the scope of which is to be limited only by the following claims.

I claim:

1. A nursing unit for holding a retention bag comprising an elongated tubular body having an exterior surface which is substantially circular at both its top and bottom ends and has substantially circular openings at both said top and bottom ends, said exterior surface of said tubular body at said bottom end having a predetermined diameter, and said exterior surface of said tubular body having a progressively smaller diameter than said predetermined diameter along a substantial distance of said surface of said body from said bottom end toward said top end;

external threading on said body adjacent said circular opening at said top end of said body;

a substantially circular retainer ring;

internal threading in said retainer ring adapted to mate with said external threading on said elongated tubular body;

a substantially circular flange extending inwardly about said retainer ring above said internal threading, said flange mating with the upper edge of said top end of said tubular body when said retainer ring is screwed onto said tubular body;

a substantially circular lip extending outwardly from said retainer ring and above said flange, the outer diameter of said lip being substantially the same as said predetermined diameter of said exterior surface at said bottom end of said tubular body; and a substantially rigid hood comprising a circular top panel and a cylindrical skirt projecting downwardly from the perimeter of said top panel, the free edge of said cylindrical skirt opposite said top panel defining a circular opening in said hood, at least a substantial portion of the interior surface of said cylindrical skirt extending axially from said free edge of said skirt towards said top panel, said substantial portion having a predetermined constant diameter such that said skirt frictionally fits about said lip when said hood is mounted on said retainer ring and such that the entirety of said substantial axial portion of said interior surface of said skirt continuously, frictionally engages said exterior surface of said tubular boy at said bottom end as said hood is pressed upwardly over said bottom end of said tubular body;

whereby said hood may be frictionally fitted about said circular lip to close said nursing unit when not in use and about said bottom end of said tubular body to cover and prevent access to said circular opening in said bottom end of said tubular body when said nursing unit is in use.

* * * * *